US006705091B1

(12) United States Patent
Kim et al.

(10) Patent No.: US 6,705,091 B1
(45) Date of Patent: Mar. 16, 2004

(54) SYSTEM AND METHOD FOR CONTROLLING ICE SIZE OF ICE MAKER

(75) Inventors: Ill-Shin Kim, Changwon (KR); Seong-Wook Kim, Jinju (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/295,944

(22) Filed: Nov. 18, 2002

(30) Foreign Application Priority Data

Nov. 20, 2001 (KR) ..... 2001-72453

(51) Int. Cl.[7] ..... F25C 1/12

(52) U.S. Cl. ..... 62/74; 62/233

(58) Field of Search ..... 62/74, 137, 233, 62/347

(56) References Cited

U.S. PATENT DOCUMENTS

| | | | |
|---|---|---|---|
| 3,396,552 A | 8/1968 | Buchser | 62/233 |
| 3,779,032 A | 12/1973 | Nichols | 62/233 |
| 6,092,374 A | 7/2000 | Kang et al. | 62/74 |

*Primary Examiner*—William E. Tapolcai
(74) *Attorney, Agent, or Firm*—Fleshner & Kim, LLP

(57) ABSTRACT

A system for controlling ice size of an ice maker comprises: an ice size controlling means for controlling a size of ice which will be frozen in an ice maker; an ice size displaying means for displaying ice size controlled by the ice size controlling means so that a user can identify it; and a controlling means for controlling the ice size displaying means according to a signal applied from the ice size controlling means and controlling an amount of water supplied to an ice making vessel, and therefore, the ice size can be controlled easily to be the size desired by a user and the size can be identified visually.

15 Claims, 4 Drawing Sheets

SYSTEM AND METHOD FOR CONTROLLING ICE SIZE OF ICE MAKER

BACKGROUND OF THE INVENTION

1. Field of the Invention

The present invention relates to an ice maker used in a refrigerator, and particularly, to a system and a method for controlling ice size in the ice maker which are able to control a size of ice and to display the size of ice visually.

2. Description of the Background Art

Generally, an ice maker which is installed additionally in a freezing device and a cooling device is a device for making ices using a cooling cycle disposed in the freezing or cooling device.

FIG. 1 is a perspective view showing a conventional ice maker from upper part, and FIG. 2 is a perspective view showing the conventional ice maker from lower part.

The ice maker according to the conventional art comprises: an ice making vessel 102 having a plurality of cavities and mounted on a certain position where the cool air of the refrigerator can be supplied; an ejector 104 mounted on an upper side of the ice making vessel 102 to be rotatable for separating the ices on the ice making vessel 102 and moving the ices to a storage vessel (not shown); a heater 106 installed on a lower side of the ice making vessel 102 for heating the ice making vessel in order to separate the ices frozen on the ice making vessel 102 easily; and a adjusting dial 108 installed on one side of the ice making vessel 102 for adjusting amount of water supplied to the ice making vessel 102.

In addition, a detecting lever 110 installed on one side of the ice making vessel 102 for turning off the operation of ice maker when the storage vessel is full of ices, a water supply tube 112 for supplying water into the ice making vessel 102, and a water supply valve 114 installed on one side of the water supply tube 112 for supplying or blocking the water into the ice making vessel by opening/closing the water supply tube 112.

Operations of the ice maker for refrigerator according to the conventional art will be described as follows.

When the water filled in the respective cavities of the ice making vessel 102 is frozen by the cool air supplied from the cooling system, the heater 106 is operated to heat the ice making vessel so that the ices on the ice making vessel 102 can be separated easily. After that, the ejector 104 is operated to move the ices frozen in the ice making vessel 102 to the storage vessel.

And than, when the water supply valve 114 is opened, the water is supplied to the ice making vessel 102 through the water supply tube 112. At that time, when a user selects desired ice size by rotating the adjusting dial 108, the opening time of the water supply valve 114 is adjusted to adjust the amount of water supplied to the ice making vessel 102, and thereby adjusting the ice size.

However, in the ice maker according to the conventional art constructed and operated as above, since the user adjusts the water supply amount by rotating the adjusting dial 108, it is difficult to control the water amount supplied to the ice making vessel precisely. Also, the user is not able to identify the amount of water supplied to the ice making vessel, and therefore it is difficult to make the ice size as the user wants.

Also, in case that water pressure is different from locations where the ice maker is installed, the size of ices is variable according to the installed location when the water supply time is set to be constant. Therefore, to solve the above problem, as another example of water supply controlling device, a system for maintaining the size of ices frozen in the ice making vessel constantly by adjusting water supplying time according to the water pressure is used presently.

However, in case of above water supply controlling device, the user is not able to control the size of ices selectively, although the size of ice can be maintained constantly.

SUMMARY OF THE INVENTION

Therefore, an object of the present invention is to provide a system and a method for controlling ice size in an ice maker by which size of ice can be controlled in a simple way as a user wants, and the size can be identified visually to control the ice size in detail.

To achieve the object of the present invention, as embodied and broadly described herein, there is provided a system for controlling ice size of an ice maker comprising: an ice size controlling means for controlling a size of ice which will be frozen on an ice maker; an ice size displaying means for displaying the ice size controlled by the ice size controlling means visually so that a user can identify; and a controlling means for controlling the ice size displaying means according to a signal applied from the ice size controlling means and for controlling an amount of water supplied to an ice making vessel.

The ice size controlling means is installed on a front surface of the ice maker, and formed as a push button which controls the size of ice according to the number of times pushed by the user.

The ice size displaying means is disposed on the front surface of the ice maker, and comprises a plurality of display devices lighted sequentially according to the number of pushing times.

A light emitting display (LED) is used as the display device.

The controlling means comprises a control unit for lighting the display devices gradually by recognizing the number of pushing times to light and for controlling the amount of water supplied to the ice making vessel by controlling opening time of the water supply valve.

The control unit includes a timer for counting opening time of the water supply valve according to the number of pushing times of the push button.

There is provided a method for controlling ice size in an ice maker according to the present invention comprises: a first step for choosing ice size when the ice maker is operated; a second step for displaying the ice size visually when the ice size is selected; a third step for setting and storing water supply time corresponding to the selected ice size; a fourth step for supplying water to the ice making vessel and deciding whether or not the set time is reached, when the supplying time is set in the third step; and a fifth step for stopping water supply and starting freezing operation when the water supplying time reaches to the set time in the fourth step.

In the first step, the size of ice is gradually increased as the user pushes the push button.

In the second step, a plurality of display devices are lighted gradually as the size of ice is increased so that the user can identify the size of ice visually.

In the fourth step, when the set time is reached by counting the time from the time point when the water supply valve which opens/closes the water supply tube is opened, the water supply is blocked by closing the water supply valve, and after that the freezing operation is performed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments for a system and a method for controlling ice size of an ice maker according to the present invention, and hereinafter, the most preferred embodiment will be described.

Figure 1:
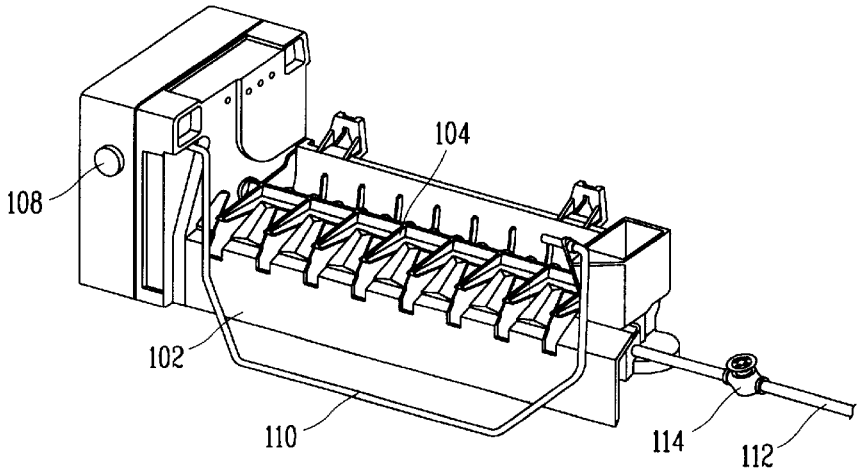
FIG. 1 BACKGROUND ART
FIG. 1 is a perspective view showing an ice maker according to the conventional art shown from upper part.
Figure 2:
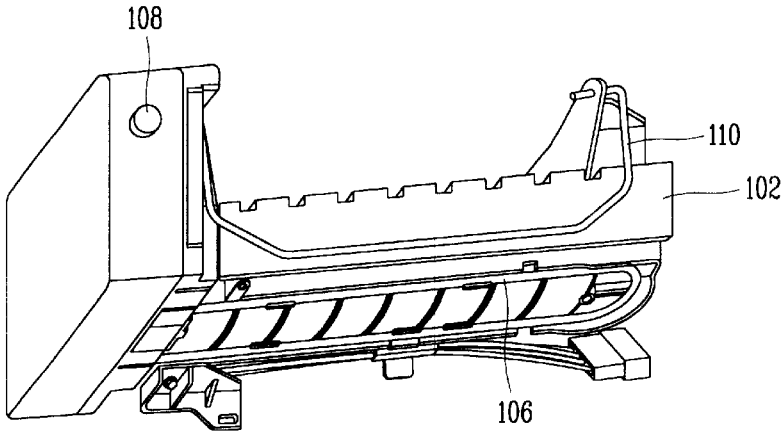
FIG. 2 BACKGROUND ART
FIG. 2 is a perspective view showing the ice maker according to the conventional art shown from lower part.
Figure 3:
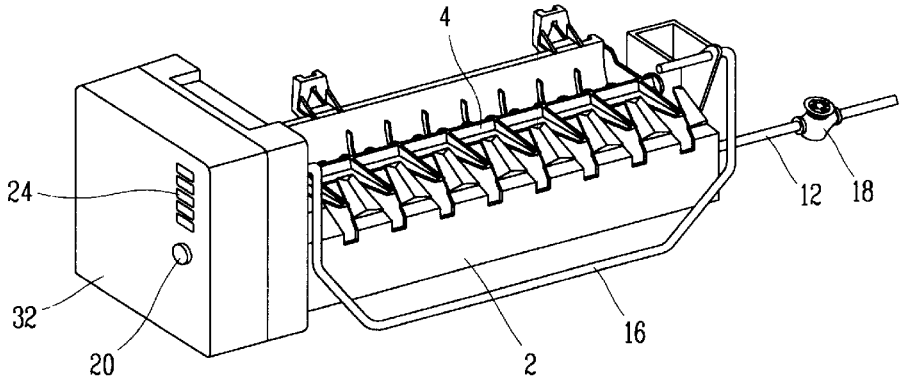
FIG. 3 is a perspective view showing an ice maker according to the present invention.
Figure 4:
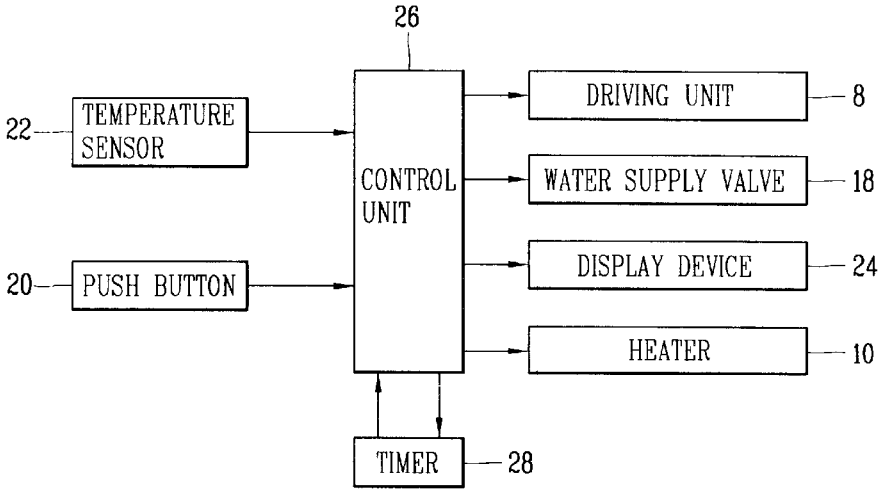
FIG. 4 is a block diagram showing a system for controlling ice size in the ice maker according to the present invention.

FIG. 3 is a perspective view showing an ice maker according to the present invention, and FIG. 4 is a block diagram showing a system for controlling ice size of the ice maker according to the present invention.

The ice maker for a refrigerator according to the present invention comprises: an ice making vessel 2 having a plurality of cavities divided by partitions; an ejector 4 installed on an upper side of the ice making vessel 2 to be rotatable for separating made ices from the ice making vessel 2; a heater 10 installed on a lower side of the ice making vessel 2 for heating the ice making vessel 2 in order to separate the ices easily; and an ice size controlling system for controlling the size of ice frozen in the ice making vessel 2.

The ice making vessel 2 has a plurality of cavities, in which the ices are made, a water supply tube 12 for supplying water into the ice making vessel connected to one side thereof, a storage vessel (not shown) in which the frozen ices are stored mounted on a lower side thereof, and a detecting lever 16 for turning off the operation of ice maker when the ices are filled in the storage vessel. In addition, a temperature sensor 22 is attached in the ice making vessel 2 for detecting the temperature of ice making vessel.

Herein, a water supply valve 18 installed on the water supply tube 12 for opening/closing the water supply tube 12 so as to control the amount of water supplied into the ice making vessel 2.

The ice size controlling system comprises: an ice size selecting means installed on a front surface 32 of the ice maker, and adjusted by a user for selecting a size of ice; an ice size displaying means disposed on one side of the ice maker or on one side of the refrigerator for displaying the ice size so that the user can identify it visually; and a controlling means for operating the ice size displaying means according to a signal applied from the ice size controlling means and controlling the amount of water supplied to the ice making vessel 2.

The ice size selecting means is disposed on a position which can be easily controlled by the user such as one side of the ice maker 2 or one side of the refrigerator, and comprises a push button 20 for controlling the size of ice by the number of pushing times of the user.

That is, when the user pushes the push button 20 once, the size of ice is the smallest, and the size of ice is gradually increased whenever the user pushes the push button 20 one by one. At that time, the number of pushing the push button 20 is limited to a certain number, and therefore, if the user pushes the button 20 more than the limited number, the controlling means recognizes as the limited number to prevent the water from being supplied more than a certain degree to the ice making vessel 2.

The ice size displaying means is disposed on a position which can be identified visually by the user such as on the front surface 32 of the ice making vessel 2, and comprises a plurality of display devices 24 light sequentially according to the number of pushing times by the user.

Herein, it is desirable that a light emitting display (LED) is used as the display device 24.

The ice size displaying means has the display devices 24 as many as the limited number of pushing of the push button 20, and one display device 24 is lighted when the push button 20 is pushed once. In addition, the number of lighted display device 24 is increased as the number of pushing the push button 20 is increased, and all display devices 24 are lighted when the number of pushing times is maximum.

The controlling means comprises a control unit 26 for lighting the display device 24 sequentially by recognizing the number of pushing times and for controlling the amount of water supplied to the ice making vessel 2 by controlling opening time of the water supply valve 18, and a timer 28 for counting the opening time of the water supply valve 18 according to the number of pushing times.

A method for controlling ice size of the ice maker constructed as above will be described as follows.

Figure 5:
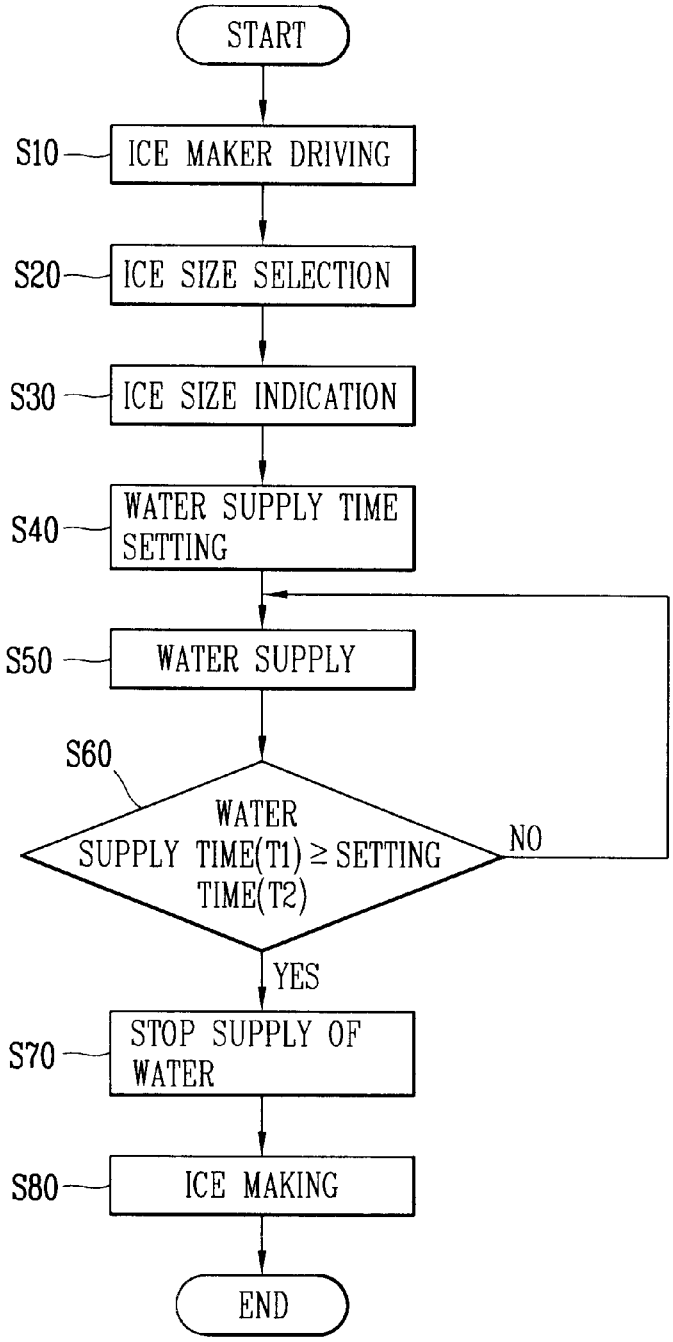
FIG. 5 is a flow chart illustrating a method for controlling ice size of the ice maker according to the present invention.

FIG. 5 is a flow chart illustrating the method for controlling ice size of the ice maker according to the present invention.

When the ice maker is turned on, the user selects the ice size (S10 and S20). That is, when the ice maker is turned on, the user sets desired ice size by pushing the push button 20 as certain times.

When the ice size is selected in above process, the ice size is display so that the user can identify the size visually (S30). That is, when the user pushes the push button 20 as certain times, the control unit 26 recognizes it and lights the display devices 24 as many as the pushing times.

In above process, when the ice size is selected, the water supplying time to the ice making vessel 2 is set (S40). That is, when a signal of the push button 20 is applied to the control unit 26, the water supplying time is set based on the pushing times of the button 20.

When the water supplying time is set, the water is supplied to the ice making vessel 2 (S50). That is, the control unit 26 opens the water supply valve 18 to supply the water to the ice making vessel 2 though the water supply tube 12.

Then, the time of water supply (T1) to the ice making vessel is counted to check whether the time (T1) reaches to the set time (T2) (S60). That is, the control unit 26 counts the opening time of the water supply valve 18 using the timer 28, and compares the time to the set time (T2) to the time of water supply(T1) to check whether the opening time of the water supply valve 18 reaches to the set time (T2).

In above process, if it is decided that the water supply time (T1) reaches to the set time (T2), the water supply is stopped and freezing operation is started (S70 and S80). That is, the control unit 26 stops the water supply to the ice making vessel 2 by closing the water supply valve 18 if it is decided that the opening time of the water supply valve reaches to the set time after comparing the opening time of the water supply valve to the set time. As above, when the ice size is set, the freezing operation is performed to make the ice.

Figure 6:
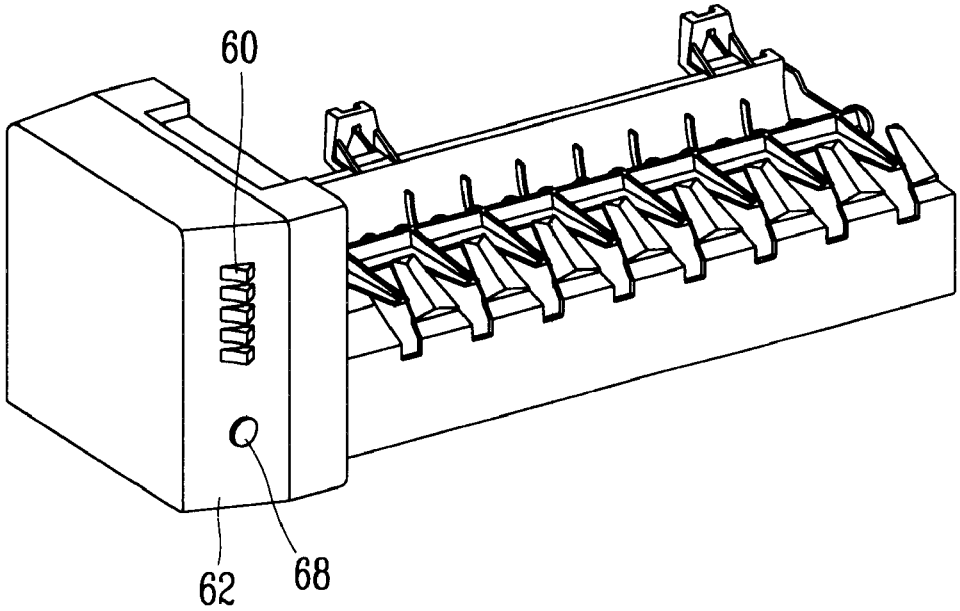
FIG. 6 is a perspective view showing a system for controlling ice size in an ice maker according to another embodiment of the present invention.

FIG. 6 is a perspective view showing a system for controlling ice size of an ice maker according to another embodiment of the present invention.

The ice size controlling system according to another embodiment has a structure that a display device 60 displaying the ice size is installed on a side surface 62 of the ice maker and formed to be protruded as a certain width. In addition, a push button 68 is also installed on the side surface of the ice maker.

That is, when the ice maker is installed in the refrigerator, the display device 60 can be shown on the side surface 62 of the ice maker as well as on the front surface of the ice maker, and thereby the ice maker can be installed freely.

Effects of the system and method for controlling ice size of the ice maker according to the present invention constructed and operated as above will be described as follows.

When the user controls the pushing times of the push button, the amount of water supplied to the ice making vessel is controlled to control the ice size, and the display device is installed on one side of the ice maker to make the user identify the ice size visually. Therefore, the ice of desired size can be made precisely.

Also, according to the ice size controlling system, the ices of desired size can be obtained regardless of water pressure supplied to the ice maker, and therefore, it is very convenient to use.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A system for controlling ice size of an ice maker, comprising:

a button installed on a surface of an ice maker and configured to generate at least one signal based on a number of times the button is pushed;

a plurality of display devices provided on a surface of the ice maker and configured to be lighted sequentially based on the number of times the button is pushed, so as to visually display ice size to a user; and a controller configured to control the sequential lighting of the plurality of display devices and to control an amount of water supplied to an ice making vessel based on a signal received from the button.

2. The system of claim 1, wherein the button is installed on a front surface of the ice maker.

3. The system of claim 1, wherein the plurality of display devices are installed on a side surface of the ice maker, and formed protruded from the surface of the ice maker a predetermined width.

4. The system of claim 1, wherein the plurality of display devices comprise light emitting devices.

5. The system of claim 1, wherein the controller comprises a control unit configured to sequentially light the plurality of display devices based on the number of times the button is pushed and to control the amount of water supplied to the ice making vessel by controlling an opening time of a water supply valve.

6. The system of claim 5, wherein the control unit comprises a timer configured to measure the elapsed open time of the water supply valve.

7. A method for controlling ice size of an ice maker, comprising:

providing a selector that selects ice size when the selector is actuated by a user, wherein the selector is provided on a surface of the ice maker;

visually displaying ice size as the ice size is selected;

setting and storing a water supply time corresponding to the selected ice size;

supplying water to an ice making vessel until the set water supply time is reached; and stopping water supply and starting a freezing operation when an actual water supply time reaches the set water supply time.

8. The method of claim 7, wherein the size of ice is gradually increased as the number of times the button is pushed increases.

9. The method of claim 7, wherein ice size is displayed by sequentially lighting a plurality of display devices as ice size is increased, so as to visually display ice size to a user.

10. The method of claim 7, wherein the freezing operation is performed after blocking a water supply by closing a water supply valve when an opening time of the water supply valve reaches the set water supply time.

11. An ice size control system for an ice maker, comprising:

a selector installed on a surface of the ice maker and configured to be depressed by a user in order to select an ice size, and to generate at least one corresponding signal based on the user's selection;

a plurality of display devices provided in close proximity to the selector and configured to provide a visual indication of ice size to the user as the selector is depressed; and a controller configured to control the visual indication provided by the plurality of display devices based on a signal received from the selector, and to control an amount of water supplied to an ice making vessel based on a signal received from the selector.

12. The apparatus of claim 11, wherein the selector comprises a push button installed on a surface of the ice maker.

13. The apparatus of claim 11, wherein the selector comprises a push button installed on a side surface of the ice maker, and wherein the plurality of display devices are formed protruded from the side surface of the ice maker.

14. The apparatus of claim 11, wherein the plurality of display devices comprise a plurality of light emitting displays configured to be sequentially lit as the selector is depressed.

15. The apparatus of claim 11, wherein the controller comprises a control unit configured to control the visual indication provided by the plurality of display devices based on the signal generated when the selector is depressed, and to control an amount of water supplied to the ice making vessel by controlling an opening time of a water supply valve based on a measurement of elapsed time provided by a timer of the control unit.

* * * * *